US009428363B2

(12) United States Patent
Seifert

(10) Patent No.: US 9,428,363 B2
(45) Date of Patent: Aug. 30, 2016

(54) WINDING SYSTEM HAVING AT LEAST ONE WINDING DEVICE

(71) Applicant: Dietze + Schell Maschinenfabrik GmbH & Co. KG, Coburg (DE)

(72) Inventor: Peter Seifert, Coburg (DE)

(73) Assignee: Dietze + Schell Maschinenfabrik GmbH & Co. KG, Coburg (DE)

( * ) Notice: Subject to any disclaimer, the term of this patent is extended or adjusted under 35 U.S.C. 154(b) by 135 days.

(21) Appl. No.: 14/338,745

(22) Filed: Jul. 23, 2014

(65) Prior Publication Data

US 2015/0175382 A1 Jun. 25, 2015

(30) Foreign Application Priority Data

Dec. 19, 2013 (DE) ..... 20 2013 105 820 U

(51) Int. Cl.

| | |
|---|---|
| ***B65H 19/30*** | (2006.01) |
| ***B65H 57/00*** | (2006.01) |
| ***B65H 54/20*** | (2006.01) |
| ***B65H 57/14*** | (2006.01) |
| ***B65H 57/16*** | (2006.01) |
| ***B65H 23/32*** | (2006.01) |

(Continued)

(52) U.S. Cl.

CPC ..... *B65H 57/00* (2013.01); *B65H 18/021* (2013.01); *B65H 18/10* (2013.01); *B65H 18/106* (2013.01); *B65H 19/30* (2013.01); *B65H 23/32* (2013.01); *B65H 54/20* (2013.01); *B65H 57/14* (2013.01); *B65H 57/16* (2013.01); *B65H 2301/3121* (2013.01); *B65H 2301/33216* (2013.01); *B65H 2301/342* (2013.01); *B65H 2701/37* (2013.01)

(58) Field of Classification Search

CPC ..... B65H 19/305; B65H 2405/422; B65H 19/2292

USPC ..... 242/533.1–533.2, 533.7–533.8, 559.3

See application file for complete search history.

(56) References Cited

U.S. PATENT DOCUMENTS 3,332,636 A * 7/1967 Rockstrom ..... B65H 198/2284 242/530.4

3,690,583 A * 9/1972 Herman ..... B21C 47/24 242/531

(Continued)

FOREIGN PATENT DOCUMENTS

DE 4011405 A1 10/1991

DE 102012206502 A1 10/2013

(Continued)

OTHER PUBLICATIONS

Extended European Search Report issued on Jun. 11, 2015 in the corresponding EP application No. 14196556.6.

*Primary Examiner* — Sang Kim

(74) *Attorney, Agent, or Firm* — Posz Law Group, PLC

(57) ABSTRACT

A winding system having at least one winding device for winding up at least one ribbon-form material to be wound onto at least one exchangeable tube that is drivable in rotation about a winding axis, and having at least one feed device which is provided to supply the at least one ribbon-form material to be wound, comprising at least one deflecting unit which is provided to deflect the at least one ribbon-form material to be wound coming from the at least one feed device, during at least one winding-up operation, as said ribbon-form material to be wound travels to the at least one winding device, about at least one axis which extends at least substantially parallel to a direction of the gravitational force.

16 Claims, 3 Drawing Sheets

(51) Int. Cl.
*B65H 18/02* (2006.01)
*B65H 18/10* (2006.01)

(56) References Cited

U.S. PATENT DOCUMENTS 3,877,653 A * 4/1975 Foltyn ..... B65H 67/052 242/474.4
4,431,142 A * 2/1984 Kataoka ..... B65H 19/2292 242/418
4,875,632 A * 10/1989 Kataoka ..... B65H 18/10 242/530
4,988,052 A * 1/1991 Urban ..... B65H 19/2284 242/524.1
6,193,185 B1 * 2/2001 Kim ..... B65H 54/205 242/473.5
7,380,745 B2 * 6/2008 Narita ..... B65H 18/021 242/530.1
2005/0072873 A1 4/2005 Heikaus

FOREIGN PATENT DOCUMENTS

EP 0896940 A1 2/1999
JP 563244 A 1/1981

* cited by examiner

WINDING SYSTEM HAVING AT LEAST ONE WINDING DEVICE

CROSS REFERENCE TO RELATED APPLICATION

This application is based on and incorporates herein by reference German Patent Application No. 20 2013 105 820 filed on Dec. 19, 2013.

PRIOR ART

The invention relates to a winding system according to the preamble of claim 1.

A winding system having at least one winding device for winding up at least one material to be wound onto at least one exchangeable tube that is drivable in rotation about a winding axis, and having at least one feed device which is provided to supply the at least one material to be wound, is already known. No deflection of the at least one material to be wound takes place between the at least one feed device and the at least one winding device in this winding system.

The objective of the invention is in particular to provide a generic winding system having improved properties with regard to space requirement and/or material flow. According to the invention, the objective is achieved by way of the features of Claim 1, while advantageous embodiments and developments of the invention can be gathered from the dependent claims.

Advantages of the Invention

The invention proceeds from a winding system having at least one winding device for winding up at least one ribbon-form material to be wound onto at least one exchangeable tube that is drivable in rotation about a winding axis, and having at least one feed device which is provided to supply the at least one ribbon-form material to be wound.

It is proposed that the winding system has at least one deflecting unit which is provided to deflect the at least one ribbon-form material to be wound coming from the at least one feed device, during at least one winding-up operation, as said ribbon-form material to be wound travels to the at least one winding device, about at least one axis which extends at least substantially parallel to a direction of gravitational force. A "winding device" should be understood in this connection as meaning in particular a device which has at least one winding mandrel which is provided to receive at least one exchangeable tube and/or drive it in rotation about a winding axis. A "material to be wound" should be understood in this connection as meaning in particular a material which is able to be wound up in particular for storage and/or for transport. For example, the at least one material to be wound can be at least one windable material made of plastics material and/or metal and/or textile fiber and/or paper. The expression "ribbon-form" should be understood in this connection as meaning in particular that the at least one material to be wound has a cross section in which a width extent is greater at least by a factor of 5, preferably at least by a factor of 10, advantageously at least by a factor of 50 and particularly advantageously at least by a factor of 100 than a height extent of the at least one material to be wound. A "tube" should be understood in this connection as meaning in particular a body which is provided to receive a material to be wound up, in particular on an outer surface which is convexly curved preferably at least partially and particularly advantageously entirely. Preferably, the at least one tube is configured at least partially as a hollow body, advantageously as a hollow cylinder, in particular having an annular base surface. The term "provided" should be understood as meaning in particular specifically programmed and/or designed and/or equipped. The fact that an object is provided for a particular function should be understood as meaning in particular that the object fulfills and/or executes this particular function in at least one use state and/or operating state. The fact that the at least one tube is "exchangeable" should be understood in this connection as meaning in particular that, in particular after an in particular predetermined quantity of the at least one material to be wound has been wound up, the at least one tube is replaceable with a further empty tube that is different from the at least one tube. A "winding mandrel" should be understood in this connection as meaning in particular a rotatable unit which is provided to transmit its rotary movement and/or a torque to a tube located on the winding mandrel. Preferably, the at least one winding mandrel is configured at least partially as a clamping mandrel which engages in the at least one tube and transmits a rotary movement and/or a torque to the at least one tube by means of a cohesive connection and/or by means of a form fit and/or preferably by means of a force fit, in particular by means of at least one clamping jaw. A "winding axis" should be understood in this connection as meaning in particular an axis about which a rotation of the at least one winding mandrel and/or of the at least one tube is executable in particular in order to wind up the at least one material to be wound. A "feed device" should be understood in this connection as meaning in particular a device which is provided to supply a store of a material to be wound up by the at least one winding device and/or to produce and/or generate a material to be wound up by the at least one winding device. A "feed direction" should be understood in this connection as meaning in particular a direction in which the at least one material to be wound is transported, in particular during a winding-up operation, from the at least one feed device to the at least one deflecting unit. A "winding-up operation" should be understood in this connection as meaning in particular an operation during which the at least one material to be wound is wound up onto the at least one tube by the winding device. A "deflecting unit" should be understood in this connection as meaning in particular a unit past and/or along which the material to wound coming from the feed device is guided and/or through which the at least one material to be wound is guided, during at least one winding-up operation, as said material to be wound travels to the at least one winding device, and in the process is subjected to a change in direction. The expression "at least substantially parallel" should be understood here as meaning in particular an orientation of a direction relative to a reference direction, in particular in a plane, wherein the direction has a deviation of in particular less than 5°, advantageously less than 1° and particularly advantageously less than 0.5° with respect to the reference direction.

As a result of the configuration according to the invention, a generic winding system having improved properties with regard to space requirement and/or material flow can be provided. Furthermore, advantageous guidance of the at least one material to be wound between the at least one feed device and the at least one winding device can be provided. In particular as a result of the deflection of the at least one material to be wound, a winding system can be adapted advantageously to spatial conditions. Furthermore, advantageous feeding of the at least one material to be wound from the at least one feed device to the at least one winding device can be achieved.

Furthermore, it is proposed that the deflecting unit is provided to deflect the at least one material to be wound through at least 10°, preferably through at least 30°, advantageously through at least 60° and particularly advantageously through at least 90°, in particular about the at least one axis extending at least substantially parallel to the direction of the gravitational force. As a result, an overall length and thus an overall space requirement of the winding system can advantageously be reduced.

Furthermore, it is proposed that the at least one deflecting unit is provided to deflect the at least one material to be wound coming from the feed device, during at least one winding-up operation, as said material to be wound travels to the at least one winding device, in a direction which encloses an angle of at least 30°, preferably at least 45°, advantageously at least 60° and particularly advantageously at least 80°, with the direction of the gravitational force. Particularly advantageously, the direction in which the at least one material to be wound is deflected during the at least one winding-up operation extends at least substantially perpendicularly to the direction of the gravitational force. The expression "at least substantially perpendicularly" is intended here to define in particular an orientation of a direction relative to a reference direction, wherein the direction and the reference direction, in particular when viewed in a plane, enclose an angle which deviates from a right angle by a maximum of 8°, preferably by a maximum of 5° and particularly advantageously by a maximum of 2°. As a result, advantageous feeding of the at least one material to be wound from the at least one feed device to the at least one winding device can be achieved.

Furthermore, it is proposed that the at least one deflecting unit comprises at least one deflecting roller. Preferably, the deflecting unit comprises at least one lateral guide which may be formed in particular in one piece with the at least one deflecting roller and is provided at least largely to prevent the at least one material to be wound from jumping down from the at least one deflecting roller. Preferably, a rotation axis of the at least one deflecting roller encloses an angle of at most 30°, in particular a maximum of 20°, preferably at most 10° and particularly advantageously a maximum of 5°, with the direction of the gravitational force. Advantageously, the rotation axis and the direction of the gravitational force are oriented at least substantially parallel to one another. As a result, advantageously safe and/or low-friction deflection of the at least one material to be wound can be achieved.

Furthermore, it is proposed that the winding system has at least one further winding device which is provided to wind up at least one further material to be wound, provided by the at least one feed device, onto at least one exchangeable further tube. The at least one further winding device is preferably formed at least substantially and particularly advantageously in an identical manner to the at least one first winding device. Preferably, the at least one further winding device is oriented at least substantially parallel to the at least one first winding device, wherein in particular winding axes defined by the winding devices are oriented at least substantially parallel to one another. The at least one further material to be wound extends in particular between the at least one feed device and the at least one further winding device at least substantially parallel to the at least one material to be wound, which is fed to the at least one first winding device. As a result, the quantity of material to be wound that is wound up as a whole per unit time can advantageously be increased.

Moreover, it is proposed that the winding system comprises at least one further deflecting unit which is provided to deflect the at least one further ribbon-form material to be wound coming from the at least one feed device, during at least one winding-up operation, as said further ribbon-form material to be wound travels to the at least one further winding device, about at least one further axis which extends at least substantially parallel to a direction of the gravitational force. Particularly advantageously, the direction in which the at least one further material to be wound is deflected during the at least one winding-up operation extends at least substantially perpendicularly to the direction of the gravitational force. In particular, the at least one further deflecting unit is provided to deflect the at least one further material to be wound through at least 10°, preferably through at least 30°, advantageously through at least 60° and particularly advantageously through at least 90°, in particular about the at least one further axis extending at least substantially parallel to the direction of gravitational force. Preferably, the at least one further material to be wound is deflected by the at least one further deflecting unit in a plane at least substantially perpendicular to the direction of the gravitational force. Preferably, the at least one deflecting unit comprises at least one further deflecting roller. As a result, an overall length and thus an overall space requirement of a winding system having at least one further winding device can be reduced. Furthermore, advantageously safe and/or low-friction deflection of the at least one further material to be wound can be achieved. Furthermore, advantageous feeding of the at least one further material to be wound from the at least one feed device to the at least one further winding device can be achieved.

Furthermore, it is proposed that the winding system comprises at least one transporting device which is arranged downstream of the at least one winding device and is provided to transport away loaded tubes, wherein a transporting direction extends at least substantially parallel to the winding axis. A "transporting device" should be understood in this connection as meaning in particular a device which is provided to acquire loaded tubes from the at least one first winding device and/or the at least one further winding device and to move them for subsequent use and/or for storage and/or for further transport to a predetermined location. A "loaded tube" should be understood in this connection as meaning in particular a tube to which an in particular predetermined quantity of a material to be wound has been applied during a winding-up operation. As a result, advantageously rapid and/or directed transporting away of loaded tubes can be made possible.

In a further preferred embodiment of the invention, it is proposed that the at least one winding device comprises at least one handling unit which is provided to transfer loaded tubes to the at least one transporting device, wherein a transfer direction extends at least substantially perpendicularly to the winding axis. A "handling unit" should be understood in this connection as meaning in particular a unit which brings about, within the winding device, a material flow, in particular a flow of tubes, away from the at least one winding mandrel. Preferably, the at least one handling unit operates automatically and/or at least semi-automatically. Preferably, a transfer direction of the at least one handling unit extends at least substantially in the same direction as a direction in which the at least one material to be wound is led to the at least one winding device. As a result, an advantageously directed material flow within the winding system can be achieved.

DRAWINGS

Further advantages can be gathered from the following description of the drawings. An exemplary embodiment of the invention is illustrated in the drawings. The drawings, the description and the claims contain numerous features in combination. A person skilled in the art will expediently also consider the features individually and combine them to form appropriate further combinations.

DESCRIPTION OF THE EXEMPLARY EMBODIMENTS

Figure 1:
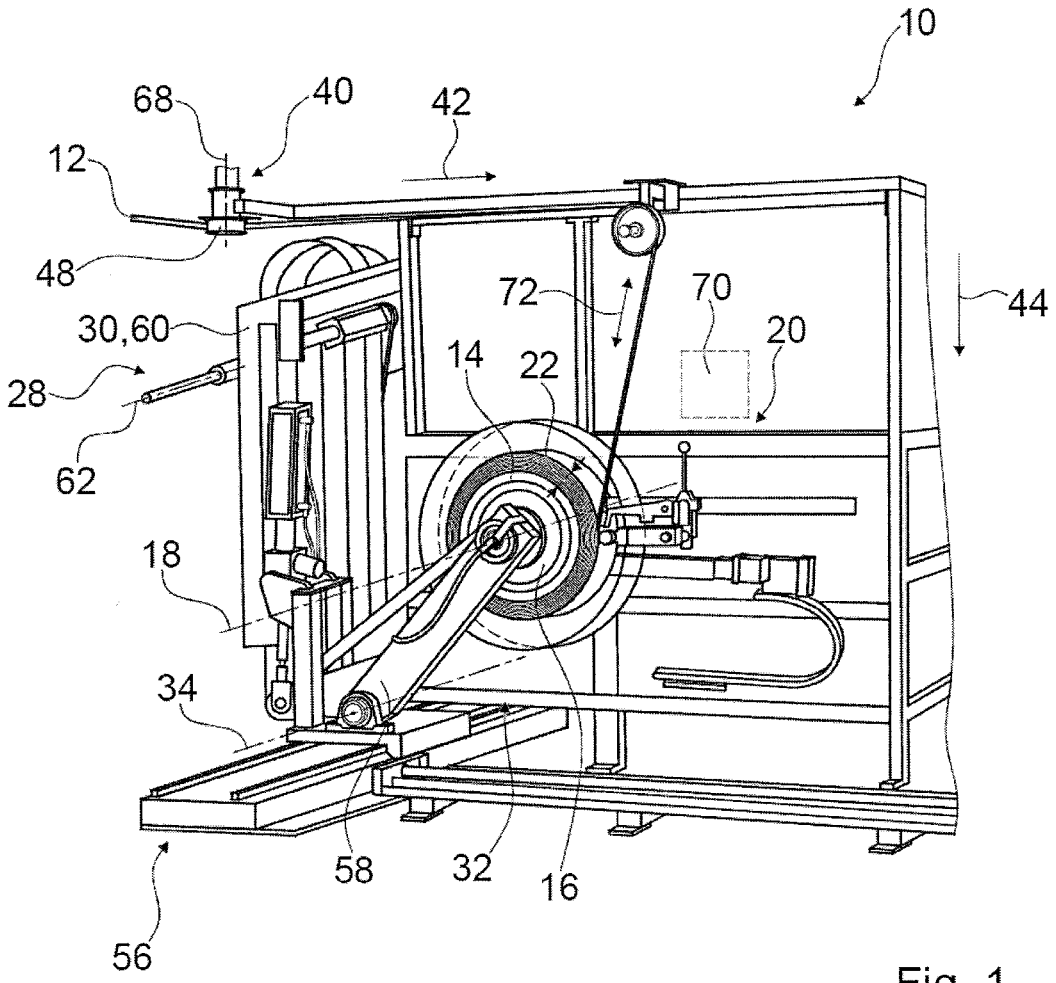
FIG. 1 shows a winding device during a winding-up operation.

FIG. 1 shows a winding device 10 for winding up a strip-form material to be wound 12 onto an exchangeable tube 14. However, the use of other materials to be wound having a geometry that differs from a strip form likewise conceivable. In order to wind up the material to be wound 12, the tube 14 is driven in rotation about a winding axis 18 by means of a winding mandrel 16.

During the winding-up operation, a mass of the material to be wound 12 that has already been wound up onto the tube 14 is continuously determined. Instead of continuous determination, time-discrete recording, in which the time intervals between individual recording times should be selected depending on a winding speed and/or an overall duration of a winding-up operation, would also be conceivable. For this purpose, the winding device 10 has a mass-determining unit 20, which records a mass characteristic of the already wound-up material to be wound 12. The mass characteristic may be the mass of the already wound-up material to be wound 12 itself, which is recorded for example directly by the mass sensor. Preferably, however, the mass characteristic is a characteristic by way of which the mass of the already wound-up material to be wound 12 is recordable indirectly.

Thus, for example during the winding-up operation, an overall thickness 22 of the material to be wound 12 that has already been wound up on the tube 14 can be recorded by the mass-determining unit 20. This may take place for example such that the mass-determining unit 20 undergoes a change in position on account of the overall thickness 22 increasing during the winding-up operation, wherein a displacement travel of the mass-determining unit 20 corresponds to the overall thickness 22 of the already wound-up material to be wound 12. When the width of the tube 14 and the density of the material to be wound 12 are known, the mass of the already wound-up material to be wound 12 is calculable exactly on the basis of the recorded overall thickness 22 of the material to be wound 12 that has already been wound up. Alternatively, it would likewise be conceivable for a length of an already wound-up material to be wound to be recorded by a mass-determining unit. When the cross-sectional geometry and density of a material to be wound is known, the mass of the already wound-up material to be wound is calculable on the basis of the recorded length. Furthermore, it is likewise possible to weigh a tube loaded with a predetermined quantity of a material to be wound and to use the recorded values as reference values for determining the mass during a winding-up operation.

Furthermore, the winding device 10 has an open-loop and/or closed-loop control unit 70, which is illustrated merely in an indicated manner here. The open-loop and/or closed-loop control unit 70 is provided to set, during a winding-up operation, a tension 72 that acts in the material to be wound 12 to a fixed value, coordinated in particular with the material to be wound 12, taking into account the mass characteristic. To this end, the open-loop and/or closed-loop control unit 70 acquires the at least one mass characteristic recorded by the at least one mass-determining unit 20 and evaluates said mass characteristic, in particular on the basis of parameters and/or calculation formulas stored in the open-loop and/or closed-loop control unit 70. The tension 72 is set by the open-loop and/or closed-loop control unit 70 during a winding-up operation by way of a change in the torque of the winding mandrel 16 and/or of a drive unit (not illustrated here) which is provided to set the winding mandrel 16 into a rotary movement. In the process, the open-loop and/or closed-loop control unit 70 increases the torque as the mass and/or the mass characteristic increases. The increase in the torque takes place proportionally to an increase in the mass characteristic and/or of the mass, with the result that the tension 72 is kept constant throughout the winding-up operation.

Figure 2:
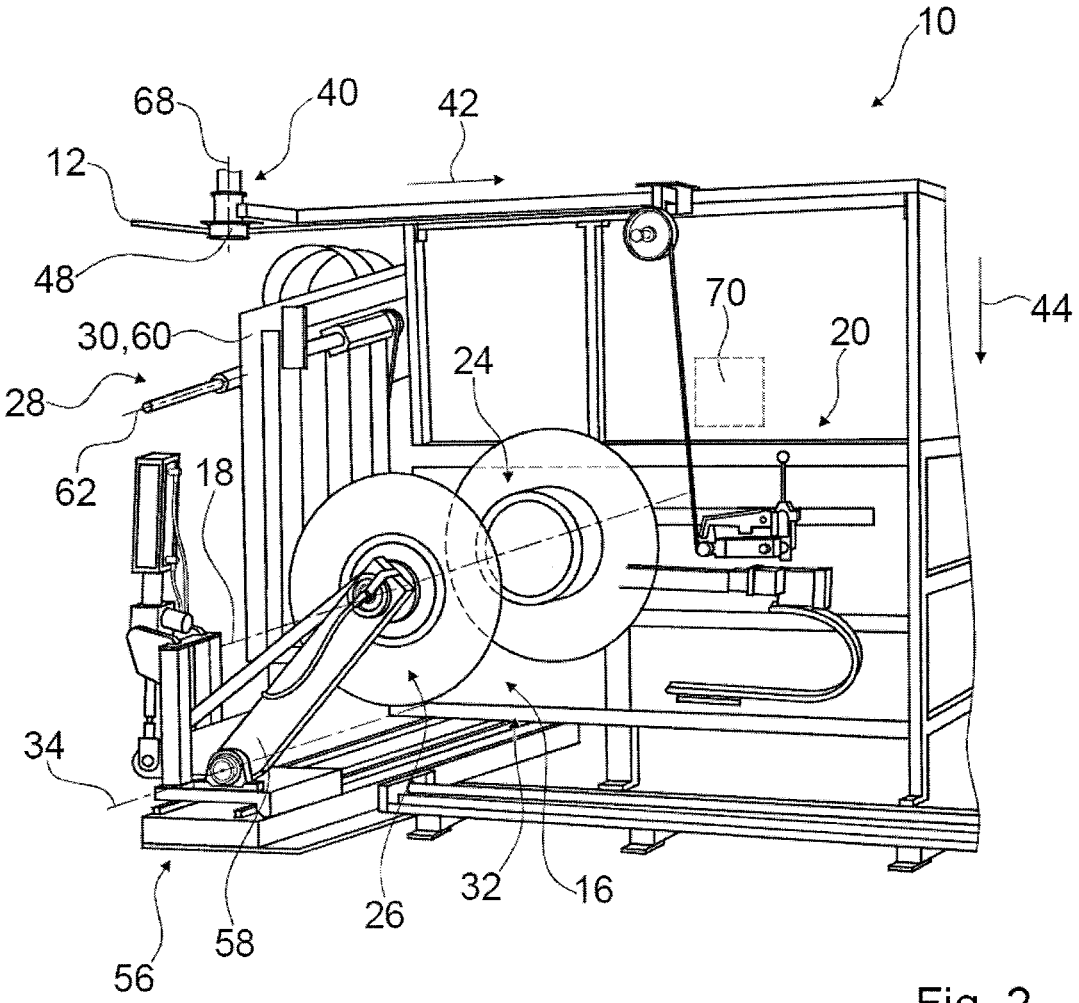
FIG. 2 shows the winding device from FIG. 1 with a divided winding mandrel.

FIG. 2 shows the winding device 10 from FIG. 1 between two winding-up operations. It can be seen that the winding mandrel 16 has a first mandrel unit 24 and a second mandrel unit 26. The first mandrel unit 24 and the second mandrel unit 26 are designed such that they are introducible from opposite sides into a tube 14 onto which the material to be wound 12 is provided to be wound up. Preferably, the first mandrel unit 24 and the second mandrel unit 26 each have a plurality of clamping jaws (not illustrated here) by way of which a force-fitting connection with an inner surface of the tube 14 is producible.

In order to insert and/or remove the tube 14, a distance between the first mandrel unit 24 and the second mandrel unit 26 is variable. To this end, the second mandrel unit 26 is on an arm 58 mounted on rails 56, such that the second mandrel unit 26 is displaceable parallel to and/or along the winding axis 18. In addition, the arm 58 is mounted so as to be pivotable about an axis 34 extending parallel to the winding axis 18, with the result that a distance between the second mandrel unit 26 and the first mandrel unit 24 is also variable perpendicularly to the winding axis 18. If the first mandrel unit 24 and the second mandrel unit 26 have been introduced fully into a tube, these together form the winding mandrel 16. During a winding-up operation, the first mandrel unit 24 and the second mandrel unit 26 are in a state in which they have been introduced fully into the tube 14. In this case, the first mandrel unit 24 and the second mandrel unit 26 are designed such that, in the state in which they have been introduced fully into the tube, there is a distance of 10 mm between an end side of the first mandrel unit 24 and an end side of the second mandrel unit 26. Depending on a width of a respectively used tube, a distance between a first mandrel unit and a second mandrel unit can vary, although the distance is never zero.

The first mandrel unit 24 is operatively connected to a drive unit (not illustrated). The drive unit is in the form for example of an electric motor. During a winding-up operation, the drive unit sets the first mandrel unit 24 into a rotary movement about the winding axis 18. The rotary movement is transmitted via the tube 14 to the second mandrel unit 26, with the result that the second mandrel unit 26 rotates about the winding axis 18 in the same direction and at the same speed as the first mandrel unit 24.

Furthermore, the winding device 10 comprises a tube-changing unit 28 which feeds the tubes 14 to the first mandrel unit 24 and transports said tubes 14 away from the first mandrel unit 24 following the completion of the winding-up operation. In this case, the tube-changing unit 28 has a first handling unit 30 and a second handling unit 32. The first handling unit 30 feeds empty tubes 14 to the first mandrel unit 24. To this end, the first handling unit 30 is in the form of an arm 60 which is movable parallel to the winding axis 18 and is pivotable about an axis 62 extending parallel to the winding axis 18. This makes it possible for the first handling unit 30 to place empty tubes 14 on the first mandrel unit 24.

The second handling unit 32 is formed from the second mandrel unit 26 and the arm 58, on which the second mandrel unit 26 is mounted. The second handling unit 32 removes the loaded tube 14 from the first mandrel unit 26 following the completion of a winding-up operation. In this case, the second mandrel unit 26 transmits a tensile force produced by a movement of the arm 58 along the rails 56 to the loaded tube 14 to be removed, with the result that the latter is removed from the first mandrel unit 24. The loaded tube 14 removed from the first mandrel unit 24 is set down for further transport by way of a pivoting movement of the arm 58 about the axis 34 extending parallel to the winding axis 18.

Figure 3:
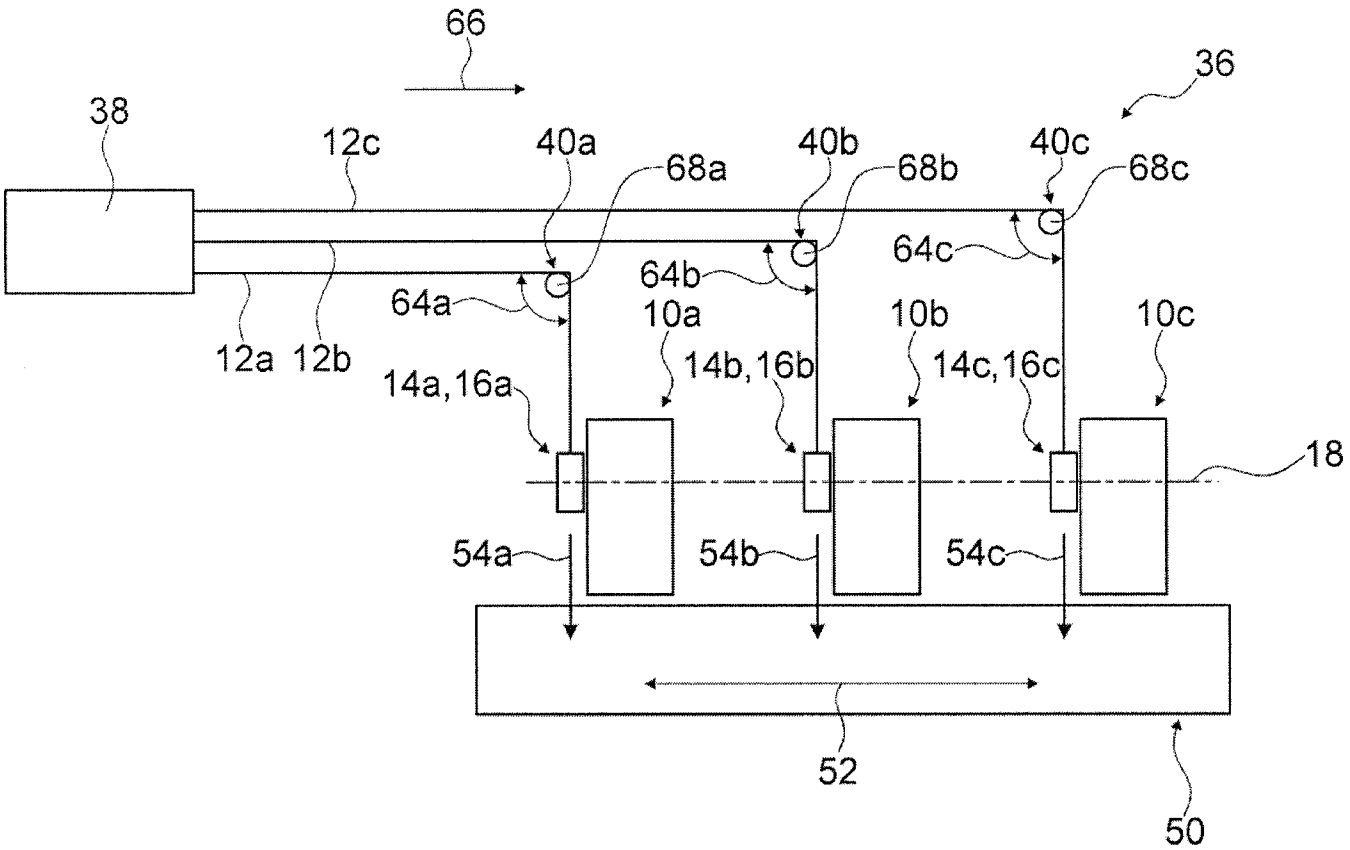
FIG. 3 shows a schematic plan view of a winding system having three winding devices and one feed device.

FIG. 3 shows a schematic plan view of a winding system 36. The winding system 36 comprises a feed device 38 and for example three winding devices 10*a*, 10*b*, 10*c*, as are shown in detail in FIGS. 1 and 2. The feed device 38 is for example an extruder which produces a material to be wound 12*a*, 12*b*, 12*c*, or a device in which a store of the material to be wound 12*a*, 12*b*, 12*c* is available. The winding devices 10*a*, 10*b*, 10*c* are oriented parallel to one another. The winding axis 18 has an identical orientation for the three winding devices 10*a*, 10*b*, 10*c*.

Each winding device 10*a*, 10*b*, 10*c* is assigned a deflecting unit 40*a*, 40*b*, 40*c* which deflects the material to be wound 12*a*, 12*b*, 12*c* coming from the feed device 38 at an angle 64*a*, 64*b*, 64*c* of 90° about an axis 68*a*, 68*b*, 68*c* which extends parallel to the direction of the gravitational force 44, as said material to be wound 12*a*, 12*b*, 12*c* travels to the winding devices 10*a*, 10*b*, 10*c*. Alternatively, a deflection of a material to be wound about an axis which extends parallel to the direction of the gravitational force can also take place about an angle of less than 90°, although the angle is at least 10°. In this case, the deflection takes place in a direction 42 which extends perpendicularly to the direction of gravitational force 44 (cf. FIGS. 1 and 2). Depending on the particular application case, a deflection can also take place in a direction which encloses an angle of less than 90° with the direction of the gravitational force, although the angle is at least 30°. A feed direction 66 of the material to be wound 12*a*, 12*b*, 12*c* extends here between the feed unit 38 and the deflecting units 40*a*, 40*b*, 40*c* for example parallel to the winding axis 18 of the winding devices 10*a*, 10*b*, 10*c*. The deflecting units 40*a*, 40*b*, 40*c* each comprise a deflecting roller 48 having a lateral guide (not illustrated in more detail) which prevents a material to be wound 12*a*, 12*b*, 12*c* from jumping down from the particular deflecting roller 48. During deflection by the deflecting unit 40*a*, 40*b*, 40*c*, the material to be wound 12*a*, 12*b*, 12*c* is rotated first of all from a horizontal orientation to a vertical orientation by the deflecting units 40*a*, 40*b*, 40*c* and returns to a horizontal orientation following deflection, with the result that damage-free deflection of the material to be wound 12*a*, 12*b*, 12*c* is achieved.

A transporting device 50 which transports away loaded tubes 14*a*, 14*b*, 14*c* is arranged downstream of the winding devices 10*a*, 10*b*, 10*c*. A transporting direction 52 of the transporting device 50 extends parallel to the winding axis 18. The loaded tubes 14*a*, 14*b*, 14*c* are in this case transferred to the transporting device 50 by a handling unit 32 of the particular winding device 10*a*, 10*b*, 10*c*. In this case, a transfer direction 54*a*, 54*b*, 54*c* extends perpendicularly to the winding axis 18, with the result that a directed material flow within the winding system 36 is achieved.

The invention claimed is:

1. A winding system comprising:

at least one winding device for winding up at least one ribbon-form material to be wound onto at least one exchangeable tube that is drivable in rotation about a winding axis;

at least one feed device that is provided to supply the at least one ribbon-form material to be wound;

at least one deflecting unit; and at least one transporting device that is arranged downstream of the at least one winding device and that is provided to transport away loaded tubes in a transporting direction that extends at least substantially parallel to the winding axis, wherein the at least one deflecting unit is provided to deflect the at least one ribbon-form material to be wound coming from the at least one feed device, during at least one winding-up operation, as said ribbon-form material to be wound travels to the at least one winding device, about at least one axis that extends at least substantially parallel to a direction of the gravitational force, wherein the at least one ribbon-form material is deflected via the at least one deflecting unit in a plane that extends at least substantially perpendicular to the direction of the gravitational force, and wherein the at least one winding device comprises at least one handling unit that is provided to transfer loaded tubes to the at least one transporting device in a transfer direction that extends at least substantially perpendicular to the winding axis.

2. The winding system according to claim 1, wherein the deflecting unit is provided to deflect the at least one ribbon-form material to be wound by at least 10°.

3. The winding system according to claim 1, wherein the at least one deflecting unit is provided to deflect the at least one ribbon-form material to be wound in a direction that encloses an angle of at least 30° with the direction of gravitational force.

4. The winding system according to claim 1, wherein the at least one deflecting unit comprises at least one deflecting roller.

5. The winding system according to claim 4, wherein a rotation axis of the at least one deflecting roller and the direction of gravitational force are oriented at least substantially parallel to one another.

6. The winding system according to claim 1, further comprising at least one further winding device that is provided to wind up at least one further ribbon-form material to be wound provided by the at least one feed device, onto at least one exchangeable further tube.

7. The winding system according to claim 6, further comprising at least one further deflecting unit that is provided to deflect the at least one further ribbon-form material to be wound coming from the at least one feed device, during at least one winding-up operation, as said further ribbon-form material to be wound travels to the at least one further winding device, about at least one further axis that extends at least substantially parallel to a direction of the gravitational force.

8. The winding system, according to claim 1, wherein the winding device comprises a mass-determining unit that records a mass characteristic of the already wound-up material to be wound, wherein the mass characteristic is the mass of the already wound-up material to be wound itself that is recorded directly by a mass sensor of the mass-determining unit.

9. The winding system according to claim 8, wherein the winding device comprises an open-loop and/or closed-loop control unit, wherein the open-loop and/or closed-loop control unit is intended to set, during a winding-up operation, a tension that acts in the material to be wound to a fixed value taking into account the mass characteristic.

10. The winding system according to claim 8, wherein the winding device further comprises an open-loop and/or closed-loop control unit configured to set a tension of the at least one ribbon-form material to be wound based on, and in response to, the mass characteristic of the at least one exchangeable tube that is detected by the mass determining unit.

11. The winding system according to claim 10, wherein the winding device further comprises a winding mandrel that supports the at least one exchangeable tube and that rotates while winding the at least one ribbon-form material to be wound onto the exchangeable tube, and the open-loop and/or closed-loop control unit is further configured to increase a torque of the winding mandrel as the mass characteristic increases so that the tension is kept constant through the winding-up operation.

12. The winding system according to claim 1, wherein the winding device comprises a tube-changing unit that feeds the tubes to a first mandrel unit of a winding mandrel of the winding device, wherein the tube-changing unit transports said tubes away from the first mandrel unit following the completion of the winding-up operation, wherein the tube-changing unit comprises a first handling unit and a second handling unit, wherein the first handling unit feeds empty tubes to the first mandrel unit, wherein the first handling unit is embodied as an arm that is movable parallel to the winding axis and is pivotable about an axis extending parallel to the winding axis.

13. The winding system according to claim 1, wherein the winding device further comprises a winding mandrel that supports the at least one exchangeable tube and that rotates while winding the at least one ribbon-form material to be wound onto the exchangeable tube, and the deflecting unit deflects the at least one ribbon-form material to be wound directly from the direction substantially perpendicular to the gravitational force to the winding mandrel.

14. The winding system according to claim 13, wherein the first deflecting roller and the second deflecting roller are mounted to the winding device such that the first deflecting roller and the second deflecting roller are located on a same plane.

15. The winding system according to claim 1, wherein the deflecting device further comprises a first deflecting roller that has a first rotational axis oriented perpendicular to the direction of gravitational force, and a second roller that is directly connected to the first deflecting roller and that has a second rotational axis oriented both parallel to the direction of gravitational force and perpendicular to the first rotational axis of the first deflecting roller.

16. The winding system according to claim 1, wherein the winding device further comprises a winding mandrel that supports the at least one exchangeable tube and that rotates while winding the at least one ribbon-form material to be wound onto the exchangeable tube, and a mass determining unit configured to determine a mass characteristic of the at least one ribbon-form material to be wound on the at least one exchangeable tube, and the open-loop and/or closed-loop control unit is further configured to increase a torque of the winding mandrel as the mass characteristic increases so that the tension is kept constant through the winding-up operation.

* * * * *